US006214483B1

(12) United States Patent
Sato et al.

(10) Patent No.: US 6,214,483 B1
(45) Date of Patent: Apr. 10, 2001

(54) MEMBER FOR MOLTEN METAL BATH, PROVIDED WITH COMPOSITE SPRAYED COATING HAVING EXCELLENT CORROSION RESISTANCE AND PEELING RESISTANCE AGAINST MOLTEN METAL

(75) Inventors: Takao Sato; Munetoshi Hiroshige; Kiyohiro Tarumi, all of Tokyo (JP)

(73) Assignee: Nippon Steel Hardfacing Co., Ltd., Tokyo (JP)

( * ) Notice: Subject to any disclaimer, the term of this patent is extended or adjusted under 35 U.S.C. 154(b) by 0 days.

(21) Appl. No.: 09/214,125

(22) PCT Filed: Apr. 27, 1998

(86) PCT No.: PCT/JP98/01927

§ 371 Date: Jan. 22, 1999

§ 102(e) Date: Jan. 22, 1999

(87) PCT Pub. No.: WO98/49364

PCT Pub. Date: Nov. 5, 1998

(30) Foreign Application Priority Data

Apr. 28, 1997 (JP) ..... 9-122904

(51) Int. Cl.[7] ..... B32B 18/00

(52) U.S. Cl. ..... 428/698; 428/699; 428/702; 428/704

(58) Field of Search ..... 428/702, 699, 428/698, 704

(56) References Cited

U.S. PATENT DOCUMENTS 4,797,156 * 1/1989 Yamashita ..... 75/251

* cited by examiner

*Primary Examiner*—Francis J. Lorin
(74) *Attorney, Agent, or Firm*—Kanesaka & Takeuchi

(57) ABSTRACT

A member for a molten metal bath is provided with a composite sprayed coating having excellent corrosion resistance and peeling resistance against a molten metal. A cermet sprayed coating lower layer including 5–60% by weight of metal boride and 5–30% by weight of at least one member selected from the group consisting of Co, Cr, Mo, and W with the balance including metal carbide and unavoidable impurities is formed on a surface of a member for the molten metal bath such as a roll in a bath, and an oxide ceramic sprayed coating surface layer including combined various oxides is formed on the cermet coating. The obtained composite coating is subjected to sealing treatment by means of an inorganic sealing agent.

7 Claims, No Drawings

MEMBER FOR MOLTEN METAL BATH, PROVIDED WITH COMPOSITE SPRAYED COATING HAVING EXCELLENT CORROSION RESISTANCE AND PEELING RESISTANCE AGAINST MOLTEN METAL

FIELD OF THE INVENTION

The present invention relates to a member for a molten metal bath such as a roll to be used in a molten zinc plating line and the like for a steel member such as a steel strip.

BACKGROUND ART

As rolls and the like to be used in a plating bath of a molten zinc plating line or a molten zinc-aluminum plating line, there have been used members obtained by spraying various cermet materials or oxide ceramic materials on a surface of a thermal resistant steel roll.

Cermet sprayed coatings applied on the surfaces of the steel member have, however, such disadvantages that corrosion resistance against a molten metal is poor and that the ceramic sprayed coatings may be easily peeled off.

As means to solve the above-mentioned problems, there has been proposed in JP-A-5-209259 a method for spraying a cermet material containing 5–60% of metal boride, 5–30% of one or more member(s) selected from the group consisting of Co, Cr, Mo and W, as well as the balance comprising carbide and unavoidable impurities on a surface of a steel member and spraying thereon an oxide ceramic. $Cr_2O_3$ is mentioned therein as an example of the oxide ceramics. Although properties thereof have been improved in use and good results have been attained, more absolute means have been required for further improvement.

On the other hand, there has been proposed in JP-A-4-350154 a sprayed coating having two-layer constitution in which an oxide ceramic sprayed layer containing $SiO_2$and the balance consisting of at least one member selected from the group consisting of MgO, CaO, $ZrO_2$, $Al_2O_3$, $Y_2O_3$ and $TiO_2$ is arranged on a lower layer of a carbide cermet sprayed layer containing one or more carbide(s) and one or more metal(s) selected from the group consisting of Co, Ni, Cr and Mo.

That is, in the case that the lower layer is a carbide cermet, fine cracks for absorbing thermal stress can be produced in the upper ceramic layer by containing 10–40% by weight of $SiO_2$ in the upper ceramic layer. It is explained therein that the sprayed coating is effective as a member for a molten metal bath.

It is, however, required to produce fine cracks in the ceramic layer (the upper layer), since the method has a prerequisite of using the carbide cermet as the lower layer. Furthermore, thermal impact resistance is improved but stability in quality against a molten metal becomes poor, since corrosion resistance and wetting resistance against a molten metal are influenced by an extent of fine longitudinal cracks.

DISCLOSURE OF THE INVENTION

An object of the present invention is to solve the problems in the above-mentioned prior art and to provide a member for a molten metal bath provided with a composite sprayed coating having excellent corrosion resistance and peeling resistance against a molten metal.

We, inventors, have studied eagerly for accomplishing the above-mentioned object and found that a combination of an upper sprayed layer (a top coat) of oxide ceramics containing two or more oxides with a lower cermet sprayed layer (a bond coat) containing boride(s) and carbide(s) has excellent corrosion resistance and peeling resistance against a molten metal. Thus, we completed the present invention.

It is an essential aspect of the present invention based on the above-mentioned finding that a member for a molten metal bath provided with a composite sprayed coating having excellent corrosion resistance and peeling resistance against molten metal comprises a cermet sprayed coating lower layer formed on a surface of a substrate and a ceramic sprayed coating surface layer formed on a surface of the coating lower layer, wherein the lower layer comprises 5–60% by weight of a metal boride and 5–30% by weight of at least one member selected from the group consisting of Co, Cr, Mo, and W with the balance consisting of a metal carbide and unavoidable impurities, and the surface layer comprises A-B type oxides in which at least one member (component A) selected from the group consisting of MgO and CaO and at least one member (component B) selected from the group consisting of $Al_2O_3$, $SiO_2$, $ZrO_2$ and $Ta_2O_5$ are combined.

Furthermore, it is also another essential aspect of the present invention to adopt a ceramic sprayed coating layer comprising C-D type oxides comprising a calcined composite member or mixed member composed of an oxide ceramic (component C) in which at least two members selected from the group consisting of MgO, CaO, $Al_2O_3$, $SiO_2$ and $Ta_2O_5$ are combined and $ZrO_2$—$Y_2O_3$ type or $ZrO_2$—$CeO_2$ type oxide (component D), to adopt a ceramic sprayed coating layer comprising $Cr_2O_3$—E type oxides in which $Cr_2O_3$ and at least one member (component E) selected from the group consisting of $Al_2O_3$, $SiO_2$, $ZrO_2$, $TiO_2$, $Ta_2O_5$, $Y_2O_3$ and $CeO_2$ are combined, or to adopt a ceramic sprayed coating layer comprising A-B-F type oxides in which at least one member (component F) selected from the group consisting of $Y_2O_3$ and $CeO_2$ is added to A-B type oxides that is a combination of at least one member (component A) selected from the group consisting of MgO and CaO and at least one member (component B) selected from the group consisting of $Al_2O_3$, $SiO_2$, $ZrO_2$ and $Ta_2O_5$.

Furthermore, it is also another essential aspect of the present invention to provide a member for a molten metal bath provided with a composite strayed coating having excellent corrosion resistance and peeling resistance against molten metal which is obtained by sealing a composite sprayed coating comprising the above-mentioned oxide ceramic sprayed coating surface layer and a cermet sprayed coating lower layer formed on a surface of a substrate and comprising 5–60% by weight of a metal boride and 5–30% by weight of at least one member selected from the group consisting of Co, Cr, Mo, and W with the balance consisting of a metal carbide and unavoidable impurities by means of an inorganic sealing agent.

It is still another essential aspect of the present invention that the sealing agent to be used is a solution of chromic acid (a solution of $H_2CrO_4$ and $H_2Cr_2O_7$), a solution of colloidal silica, a solution of a metallic alcohol compound in alcohol, a solution of a metallic salt in water or alcohol, a solution of metallic phosphate in water, a suspension of metallic hydroxide, a suspension of metallic oxide fine powders in alcohol or water, or a mixed solution of two or more of these solutions.

It is further another essential aspect of the present invention that a thickness of the above-mentioned lower layer is 20–500 $\mu$m and a thickness of the surface layer is 5–500 $\mu$m.

BEST MODE FOR CARRYING OUT THE INVENTION

The present invention is explained as follows about constitution and effects thereof.

It was confirmed that the cermet coating used in the present invention containing metallic borides such as tungsten boride is superior in corrosion resistance against molten metal.

Furthermore, it was found that a fitting property of the metallic boride with the ceramic surface layer is good since the boride forms $B_2O_3$ partly when sprayed and produces a flux action. Therefore, the coating has the following characteristics. The oxide ceramic sprayed coating surface layer formed on the cermet sprayed coating lower layer containing the metallic boride has a high fitting property with the lower layer and has superior corrosion resistance. The molten metal is hardly adhered on the coating. The surface of the layer is hardly peeled off from the lower layer. In the present invention, a spraying member containing a metallic borides such as tungsten boride WB and metallic carbides such as tungsten carbide WC is used as a cermet material for a bond coat. However, if the metallic boride is much used, the fitting property with a substrate is lowered, thus the upper limit thereof is 60% by weight. Furthermore, in the case of less than 5% by weight, an additional effect of the metallic boride is hardly obtained. Thus, a content of the metallic boride is limited to 5–60% by weight.

The metallic carbide has effects to make the cermet coating more fine and to increase hardness in addition to improve corrosion resistance. Particularly, in order to increase density of sprayed granules, heavy metallic carbides such as tungsten carbide (WC) compensate the action of the heavy metallic borides, thereby contributing to form a fine sprayed coating.

A metallic phase should be necessarily present in order that the sprayed coating lower layer containing these metallic borides and metallic carbides plays a role as a bond coat, As the bond coat metallic phase in the sprayed coating lower layer according to the present invention, there may be used Co, Cr, Mo and W alone or in combination. Ductility and toughness of the metallic phase are ensured by Co, and corrosion resistance and hardness of the metallic phase are improved by Cr, Mo and W. In order to ensure ductility, adhesion and hardness suitable as the bond coat, a content of the metallic phase is limited to 5–30% by weight. If the content is less than 5% by weight, adhesion becomes poor. If the content is above 30% by weight, hardness decreases.

A suitable thickness of the sprayed coating lower layer as the bond coat is 20–500 $\mu$m. If it is less than 20 $\mu$m, it is insufficient to play a role as the bond coat. If it is above 500 $\mu$m, an effect thereof is saturated.

The sprayed coating surface layer (top coat layer) according to the present invention is selected from the viewpoints of corrosion resistance, peeling resistance and thermal cracking resistance when used in a molten metal, particularly in a Zn bath or a Zn–Al bath.

According to the invention as set forth in the first aspect, there is used as the surface layer a ceramic sprayed coating comprising A-B type oxides in which at least one member (component A) selected from the group consisting of MgO and CaO and at least one member (component B) selected from the group consisting of $Al_2O_3$, $SiO_2$, $ZrO_2$ and $Ta_2O_5$ are combined.

As typical examples thereof, the following systems may be mentioned by weight: 29% MgO—$Al_2O_3$ system, 60% MgO—$SiO_2$ system, 67% CaO—$SiO_2$ system, 5% CaO—$ZrO_2$ system, 57% MgO—5% $Ta_2O_3$—$SiO_2$ system and 26MgO—5% $Ta_2O_3$— $Al_2O_3$ system. These sprayed coatings have, in particular, good adhesion with the sprayed coating lower layer as the bond coat and superior corrosion resistance.

According to the invention as set forth in the second aspect, there is used as the surface layer a ceramic sprayed coating comprising C-D type oxides comprising a calcined composite member or mixed member composed of an oxide ceramic (component C) in which at least two members selected from the group consisting of MgO, CaO, $Al_2O_3$, $SiO_2$ and $Ta_2O_5$ are combined, and a so-called stabilized zirconia type oxides (component D) selected from the group consisting of $ZrO_2$—$Y_2O_3$ type and $ZrO_2$—$CeO_2$ type oxide.

As typical examples thereof, the following systems may be mentioned by weight: 30%(60% MgO—$SiO_2$)—($ZrO_2$—8% $Y_2O_3$) system and 30%(57% MgO—5% $Ta_2O_3$—$SiO_2$)—($ZrO_2$—8% $Y_2O_3$) system. In these systems toughness of stabilized zirconia is utilized for the sprayed coating, and tough particles of stabilized zirconia are bonded by means of oxides having relatively low melting point such as MgO—$SiO_2$ and CaO—$SiO_2$.

According to the invention as set forth in the third aspect, there is used as the surface layer a ceramic sprayed coating comprising $Cr_2O_3$—E type oxides in which at least one member (component E) selected from the group consisting of $Al_2O_3$ to be solid dissolved in the base component, $SiO_2$ and $TiO_2$ to be used as oxides having low melting points, $ZrO_2$—$8Y_2O_3$ of stabilized zirconia system having a certain hardness and toughness, $Y_2O_3$ or $CeO_2$ for reinforcing $Cr_2O_3$ is combined with $Cr_2O_3$ used as the base component.

According to the invention as set forth in the fourth aspect, there is used as the surface layer a ceramic sprayed coating comprising A-B-F type oxides in which at least one member (component F) selected from the group consisting of $Y_2O_3$ and $CeO_2$ is added to the A-B type oxides used in the invention of the first aspect. The ceramic coating is expected to become fine by addition of these rare earth oxides.

A suitable thickness of the above-mentioned respective oxide ceramic sprayed coating is 5–500 $\mu$m. If it is less than 5 $\mu$m, it is insufficient to be effective in corrosion resistance, peeling resistance and thermal cracking resistance against a molten metal. If it is above 500 $\mu$m, inside stress is increased by sealing treatment mentioned below and the coating is easily peeled off.

The reaction between the respective oxide ceramic sprayed coating having the above-mentioned thickness and $B_2O_3$that is formed on the surface of the cermet sprayed coating lower layer used as the bond coat is effective for improving adhesion between both coatings. The reaction with $B_2O_3$ is considered to provide the so-called enamel action upon surface spraying. It is considered that adhesion, corrosion resistance and adhesive resistance of a molten metal are improved thereby and an effect for sealing pores is attained.

A high-speed gas spraying method is suitable for forming the bond coat, and a plasma spraying method is suitable for forming the top coat. However, it is not necessarily limited to them.

Respective aspects of the invention as set forth in the sixth and seventh aspects relate to sealing treatment for the composite sprayed coating by means of an inorganic sealing agent, in which the composite sprayed coating is composed of the surface layer of the oxide ceramic sprayed coating and the cermet sprayed coating lower layer formed on the surface of the substrate. The sprayed coating subjected to sealing treatment has improved corrosion resistance against a molten metal, wetting resistance and piercing resistance of a molten metal within the sprayed coating, thus the coating has improved properties suitable as a member for a molten metal bath.

As the sealing agent for pores suitable for use in the invention, liquid one that forms metal oxide finally is preferable from the viewpoint of permeability. There may be mentioned a solution of chromic acid (a solution of $H_2CrO_4$ and $H_2Cr_2O_7$), a solution of colloidal silica, a solution of a metallic alcohol compound in alcohol, a solution of metallic salt in water or alcohol, a solution of metallic phosphate in water, a suspension of metallic hydroxide, a suspension of metallic oxide fine powders in alcohol or water, or a mixed solution of two or more of these solutions.

By impregnating the above-mentioned sealing agent into the sprayed coating and heating to calcine, the sealing agent impregnated within cavities of the coatings is decomposed and oxidized to form ceramic components such as metal oxides in the coatings, thus the components are remained in the state of sealing. Heating for calcination may be sufficiently carried out at 450° C. for 30 minutes optionally, impregnation of same or different sealing agents and heating for calcination may be repeated several times.

EMBODIMENTS

The following examples illustrate the present invention without limiting it thereto.

EXAMPLES

For examples according to the present invention and comparative examples, the sprayed coating materials and the sealing agents are shown in Table 1, and results of a thermal impact test by a molten metal and results of a wetting resistant test against a molten metal are shown in Table 2.

In respective Tables, No. 1 to No. 19 are examples of the present invention, and No. 20 to No. 25 are comparative examples. No. 1 to No. 3 are the examples of the invention according to the first aspect. No. 4 to No. 6 are examples of the invention according to the second aspect. No. 7 to No. 12 are examples of the invention according to the third aspect. No. 13 to No. 15 are examples of the invention according to the fourth aspect. No. 16 to No. 19 are examples of the invention according to the first aspect in which the bond coat component comprises one or more member(s) selected from the group consisting of Cr, Mo and W, or comprises chromium boride or chromium carbide.

TABLE 1

| No. | Top Coat Component (wt %) | Sealing Agent | Bond Coat |
|---|---|---|---|
| Examples of the Present Invention | | | |
| 1 | $29MgO—Al_2O_3$ | without sealing treatment | A |
| 2 | | solution of chromic acid | A |
| 3 | | solution of Zr alcohol compound in alcohol | A |
| 4 | 30 (60MgO—$SiO_2$)—($ZrO_2$—$8Y_2O_3$) | without sealing treatment | A |
| 5 | | solution of cerium chloride | A |
| 6 | | sealing with solution of colloidal silica after sealing with solution of chromic acid | A |
| 7 | $90Cr_2O_3$—($ZrO_2$—$8Y_2O_3$) | solution of aluminum hydroxide | A |
| 8 | | suspension of $ZrO_2$ fine powders in alcohol | A |
| 9 | | solution of colloidal silica | A |
| 10 | $95Cr_2O_3$—$2Ta_2O_5$—$Y_2O_3$ | solution of aluminum hydroxide | A |
| 11 | | suspension of $ZrO_2$ fine powders in alcohol | A |
| 12 | | solution of colloidal silica | A |
| 13 | 90 (60Mgo—$SiO_2$)—$Y_2O_3$ | solution of chromic acid + solution of Zr alcohol compound in alcohol | A |
| 14 | | suspension of boron nitride fine powders | A |
| 15 | | solution of Zr alcohol compound and $ZrO_2$ fine powders in alcohol | A |
| 16 | $29MgO—Al_2O_3$ | solution of Zr alcohol compound in alcohol | B |
| 17 | | | C |
| 18 | | | D |
| 19 | | | E |
| Comparative Examples | | | |
| 20 | $Al_2O_3$ | without sealing treatment | A |
| 21 | | solution of chromic acid | A |
| 22 | 30 (60Mgo—$SiO_2$)—($ZrO_2$—$8Y_2O_3$) | solution of chromic acid | F |
| 23 | | | G |
| 24 | $29MgO—Al_2O_3$ | solution of chromic acid | H |
| 25 | $Cr_2O_3$ | solution of chromic acid | A |

Note 1. bond coat component (% by weight)
A = Co: 12% WB: 30% WC: the balance
B = Co: 10% Cr: 2% W.: 5% WB: 20% WC: the balance
C = Co: 10% Cr: 2% W: 5% WB: 20% $CrB_2$: 10% WC: the balance
D = Co: 10% Cr: 2% W: 5% WB: 40% 70WC-$Cr_3C_2$: the balance
E = Co: 12% Cr: 5% Mo: 10% WB: 30% 70WC-$Cr_3C_2$: the balance
F = Co: 12% WC: the balance
G = Ni: 25% $Cr_3C_2$: the balance
H = no
2. The bond coats were made by a high-speed gas spraying method and the top coats were made by a plasma spraying method.
3. The thickness of the bond coat was 50 μm. The sealing treatment was carried out by heating at 450° C. for 1 hour.

TABLE 2

| No. | Thermal Impact Test After Spraying Top Coat (thickness μm) 30 | 100 | 300 | Sealing Treatment | Wettability Test (days) 10 | 30 | 50 | Remarks |
|---|---|---|---|---|---|---|---|---|
| Examples of the Present Invention | | | | | | | | |
| 1 | ○ | Δ | Δ | No | ◎ | ○ | Δ | |
| 2 | ○ | ○ | ○ | Yes | ◎ | ◎ | ○ | |
| 3 | ○ | ○ | Δ | Yes | ◎ | ◎ | ○ | |
| 4 | ○ | Δ | Δ | No | ◎ | ○ | Δ | |
| 5 | ○ | ○ | Δ | Yes | ◎ | ◎ | ○ | |
| 6 | ○ | ○ | Δ | Yes | ◎ | ◎ | ◎ | |
| 7 | ○ | ○ | ○ | Yes | ◎ | ◎ | ○ | |
| 8 | ○ | ○ | Δ | Yes | ◎ | ◎ | ○ | |
| 9 | ○ | ○ | Δ | Yes | ◎ | ◎ | ◎ | |
| 10 | ○ | ○ | ○ | Yes | ◎ | ◎ | ○ | |
| 11 | ○ | ○ | Δ | Yes | ◎ | ◎ | ○ | |
| 12 | ○ | ○ | ○ | Yes | ◎ | ◎ | ◎ | |
| 13 | ○ | ○ | ○ | Yes | ◎ | ◎ | ○ | |
| 14 | ○ | ○ | Δ | Yes | ◎ | ◎ | ○ | |
| 15 | ○ | ○ | Δ | Yes | ◎ | ◎ | ◎ | |
| 16 | ○ | ○ | ○ | Yes | ◎ | ◎ | ○ | |
| 17 | ○ | ○ | Δ | Yes | ◎ | ◎ | ○ | |
| 18 | ○ | ○ | Δ | Yes | ◎ | ◎ | ○ | |
| 19 | ○ | ○ | Δ | Yes | ◎ | ◎ | ○ | |
| Comparative Example | | | | | | | | |
| 20 | ○ | Δ | X | No | Δ | X | — | |
| 21 | ○ | Δ | Δ | Yes | ○ | Δ | X | |

TABLE 2-continued

| No. | Thermal Impact Test After Spraying Top Coat (thickness μm) 30 | 100 | 300 | Sealing Treatment | Wettability Test (days) 10 | 30 | 50 | Remarks |
|---|---|---|---|---|---|---|---|---|
| 22 | ○ | ○ | Δ | Yes | ◎ | ○ | X | |
| 23 | ○ | ○ | Δ | Yes | ○ | X | — | |
| 24 | Δ | X | X | Yes | X | — | — | |
| 25 | ○ | ○ | Δ | Yes | ◎ | ○ | Δ | |

Note 1.
Thermal impact test: heating at 460° C. and cooling with water are repeated for twenty times.
Evaluation
○: no peeling of coating
Δ: partial peeling of coating
X: complete peeling of coating
note 2.
Wettability test: after impregnation in a molten zinc bath at 460° C., removed and evaluated (thickness of bond coat: 50 μm, thickness of top coat: 30 μm)
evaluation
◎: no adhesion of zinc
○: partly adhesion of zinc but easily removed
Δ: partly peeling of coating and partly adhesion of zinc
X: complete adhesion of zinc or much peeling
3. *prior invention (JP-A-5-209259)

In comparative examples No. 20 and No. 21, boride and carbide are contained in the bond coat component and $Al_2O_3$ is sprayed as the surface layer. In these cases, good results were not obtained as shown in Table 2 even though sealing treatment by impregnation of the sealing agent and calcination was carried out, which is different from the examples of the present invention.

It is supposed that the coatings are not made fine and molten zinc may easily invade in the case of only $Al_2O_3$ spraying.

Furthermore, if boride was not contained in the bond coat component, the results were worse than those containing boride in the bond coat component, even though the oxide ceramic in the surface layer had the same component as those according to the present invention and even though sealing treatment was carried out as in No. 22 and No. 23.

For No. 24, any bond coat was not applied. In this case, complete peeling of sprayed coating occurred even though the oxide ceramic in the surface layer had the same component as those according to the present invention and even though sealing treatment was carried out.

For No. 25 as an example of the prior invention (JP-A-5-209259) in which an oxide ceramic in the surface layer was a sprayed coating of $Cr_2O_3$, properties were somewhat lowered.

As clear from the results of No. 1–3 and No. 4–6, remarkable differences were found in wettability after carrying out sealing treatment regardless of the kind of the top coat.

Application examples of the member in a concrete molten metal bath are illustrated as to the above-mentioned Example No. 2.

Four rolls having an outer diameter of 300 mm and a length of 1800 mm were machine-processed over the total barrel length of the rolls. Then, the rolls were subjected to blast treatment on the surface thereof by means of #70 alumina grid. Thereafter, a spraying member for a bond coat having Co:WB:WC=52:30:12 (% by weight) was sprayed at the thickness of 50 μm by means of an HVOF gas spraying machine. For two rolls (roll A, roll B) among four rolls, a spraying member for a top coat having $MgO:Al_2O_3$=29:71 (% by weight) was sprayed at the thickness of 30 μm by means of a plasma spraying machine. For one roll (roll C) among the remained two rolls, a spraying member for a top coat having $Cr_2O_3:(ZrO_2—8Y_2O_3)$=90:10 (% by weight) was sprayed at the thickness of 80 μm by means of the plasma spraying machine. For the final one roll (roll D), a spraying member for a top coat having $Cr_2O_3:Ta_2O_3:Y_2O_3$= 95:2:3 (% by weight) was sprayed similarly to roll C.

Roll A was dried for 1 hour and rolls B, C and D were dried for 1 hour after brushed with a solution of chromic acid for the B roll and a solution of colloidal silica for the C and D rolls as the sealing agents after the above-mentioned spraying. Then, the rolls were thermally treated at 400° C. for 3 hours and cooled. They were used practically in a molten zinc plating line, respectively.

Respective rolls were taken off from a molten zinc bath after 15 days, and the surfaces of the rolls were checked. Thereafter, they were dipped in the plating bath again and used, which were repeated.

There was not found any change in a surface of the roll A after used for 75 days. On a surface of a zinc plating steel through which the roll passed, there is not produced any flaw. For rolls B, C and D, there was not produced any change for 90 days.

In the case of the rolls to which the coatings of comparative examples No. 22 and No. 25 are applied, surfaces of the rolls were partly reacted with a molten zinc to produce flaws on zinc plating steel plates and the sprayed layers on the surfaces of the rolls were peel off locally for 30–60 days in use. Thereby, the rolls should be exchanged.

From the above-mentioned points, it is proved that a life of a roll (a period during which quality of a zinc plating steel plate can be maintained) according to the present invention is improved obviously.

Industrial Applicability

Since the present invention is constituted as described above, it is possible to provide a member for a molten metal bath provided with a composite sprayed coating having excellent corrosion resistance and peeling resistance against a molten zinc bath or a molten zinc-aluminum bath, thus a long term continuous operation of a plating line becomes possible, which is quite useful in industry.

What is claimed is:

1. A member for a molten metal bath provided with a composite sprayed coating having excellent corrosion resistance and peeling resistance against molten metal, comprising a cermet sprayed coating lower layer formed on a surface of a substrate and a ceramic sprayed coating surface layer formed on the cermet coating, wherein the cermet sprayed coating lower layer comprises 5–60% by weight of metal boride and 5–30% by weight of at least one member selected from the group consisting of Co, Cr, Mo, and W with the balance comprising metal carbide, and wherein the ceramic sprayed coating surface layer comprises A-B type oxides in which at least one member (A) selected from the group consisting of MgO and CaO and at least one member (B) selected from the group consisting of $Al_2O_3$, $SiO_2$, $ZrO_2$ and $Ta_2O_5$are combined.

2. A member for a molten metal bath provided with a composite sprayed coating having excellent corrosion resistance and peeling resistance against molten metal, comprising a cermet sprayed coating lower layer formed on a surface of a substrate and a ceramic sprayed coating surface layer formed on the cermet coating, wherein the cermet sprayed coating lower layer comprises 5–60% by weight of metal boride and 5–30% by weight of at least one member selected from the group consisting of Co, Cr, Mo, and W with the balance comprising metal carbide and unavoidable impurities, and wherein the ceramic sprayed coating surface layer comprises C-D type oxides composed of a calcined composite member or mixed member of an oxide ceramic (C) in which at least two members selected from the group consisting of MgO, CaO, $Al_2O_3$, $SiO_2$ and $Ta_2O_5$ are combined and an oxide (D) selected from the group consisting of $ZrO_2$—$Y_2O_3$ type and $ZrO_2$—$CeO_2$ type oxide.

3. A member for a molten metal bath provided with a composite sprayed coating having excellent corrosion resistance and peeling resistance against molten metal, comprising a cermet sprayed coating lower layer formed on a surface of a substrate and a ceramic sprayed coating surface layer formed on the cermet coating, wherein the cermet sprayed coating lower layer comprises 5–60% by weight of metal boride and 5–30% by weight of at least one member selected from the group consisting of Co, Cr, Mo, and W with the balance comprising metal carbide, and wherein the ceramic sprayed coating surface layer comprises $Cr_2O_3$-E type oxides in which at least one member (component E) selected from the group consisting of $Al_2O_3$, $SiO_2$, $ZrO_2$, $TiO_2$, $Ta_2O_5$, $Y_2O_3$ and $CeO_2$ is combined with $Cr_2O_3$.

4. A member according to claim 1 for molten metal bath provided with a composite sprayed coating having excellent corrosion resistance and peeling resistance against molten metal, wherein the ceramic sprayed coating surface layer comprises A-B-F type oxides in which at least one member (component F) selected from the group consisting of $Y_2O_3$ and $CeO_2$ is further added.

5. A member according to claim 1 for a molten metal bath provided with a composite sprayed coating having excellent corrosion resistance and peeling resistance against molten metal, wherein a thickness of the lower layer is 20–500 $\mu$m and a thickness of the surface layer is 5–500 $\mu$m.

6. A member according to claim 1 for a molten metal bath provided with a composite sprayed coating having excellent corrosion resistance and peeling resistance against molten metal, wherein the composite sprayed coating has a sealing agent that produces a metallic oxide by calcination.

7. A member according to claim 6 for a molten metal bath provided with a composite sprayed coating having excellent corrosion resistance and peeling resistance against molten metal, wherein the sealing agent is selected from the group consisting of a solution of chromic acid, a solution of colloidal silica, a solution of a metallic alcohol compound in alcohol, a solution of a metallic salt in water or alcohol, a solution of metallic phosphate in water, a suspension of metallic hydroxide, a suspension of metallic oxide fine powders in alcohol or water, or a mixed solution of two or more of these solutions.

* * * * *